US007413474B2

(12) United States Patent
Liu et al.

(10) Patent No.: US 7,413,474 B2
(45) Date of Patent: Aug. 19, 2008

(54) COMPOSITE COAXIAL CABLE EMPLOYING CARBON NANOTUBES THEREIN

(75) Inventors: Liang Liu, Beijing (CN); Kai-Li Jiang, Beijing (CN); Shou-Shan Fan, Beijing (CN); Ceasar Chen, Santa Clara, CA (US); Hsi-Fu Lee, Taipei Hsien (TW); Ga-Lane Chen, Santa Clara, CA (US)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/564,266

(22) Filed: Nov. 28, 2006

(65) Prior Publication Data

US 2007/0293086 A1 Dec. 20, 2007

(30) Foreign Application Priority Data

Jun. 14, 2006 (CN) ..... 2006 1 0061129

(51) Int. Cl.
*H01R 9/05* (2006.01)

(52) U.S. Cl. ..... 439/579

(58) Field of Classification Search ..... 439/578, 439/579, 580; 174/36; 428/313.3; 523/137
See application file for complete search history.

(56) References Cited

U.S. PATENT DOCUMENTS

| | | | | |
|---|---|---|---|---|
| 4,461,923 | A * | 7/1984 | Bogese, II | 174/36 |
| 6,036,539 | A * | 3/2000 | Rigby et al. | 439/579 |
| 6,265,466 | B1 * | 7/2001 | Glatkowski et al. | 523/137 |
| 2004/0020681 | A1 * | 2/2004 | Hjortstam et al. | 174/102 SC |
| 2004/0071949 | A1 * | 4/2004 | Glatkowski et al. | 428/313.3 |
| 2005/0266162 | A1 * | 12/2005 | Luo et al. | |
| 2005/0276978 | A1 * | 12/2005 | Chen | |

* cited by examiner

*Primary Examiner*—Chandrika Prasad
(74) *Attorney, Agent, or Firm*—Andrew C. Cheng

(57) ABSTRACT

A coaxial cable (10) includes at least one conducting wire (110), at least one insulting layer (120) coating a respective conducting wire, at least one shielding layer (130) surrounding the at least one insulting layer, and a single sheath (140) wrapping the at least one shielding layer. The shielding layer includes a polymer material (134) and a plurality of carbon nanotubes (132) embedded in the polymer material. The coaxial cable is, advantageously, an electromagnetic interference (EMI) shield cable.

8 Claims, 4 Drawing Sheets

COMPOSITE COAXIAL CABLE EMPLOYING CARBON NANOTUBES THEREIN

RELATED APPLICATIONS

This application is related to commonly-assigned, co-pending application: entitled, "COMPOSITE CONDUCTOR AND ELECTRICAL CABLE USING THE SAME", filed Nov. 24, 2006 (application Ser. No. 11,559,840). The disclosure of the above-identified application is incorporated herein by reference.

BACKGROUND

1. Field of the Invention

The present invention relates to cables and, more particularly, to a coaxial cable.

2. Discussion of Related Art

A coaxial cable is an electrical cable including an inner conductor, an insulating layer, and a conducting layer, usually surrounded by a sheath. The inner conductor can be, e.g., a solid or braided wire, and the conducting layer can, for example, be a wound foil, a woven tape, or a braid. The coaxial cable requires an internal structure of an insulating layer (i.e., a dielectric) to maintain a physical support and a constant spacing between the inner conductor and the conducting layer, in addition to electrically isolating the two.

The coaxial cable may be rigid or flexible. Typically, the rigid type has a solid inner conductor, while the flexible type has a braided inner conductor. The conductors for both types are usually made of thin copper wires. The insulating layer, also called the dielectric, has a significant effect on the cable's properties, such as its characteristic impedance and its attenuation. The dielectric may be solid or perforated with air spaces. The shielding layer is configured for ensuring that a signal to be transmitted stays inside the cable and that all other signals to stay out (i.e., acts as a two-way signal shield). The shielding layer also serves as a secondary conductor or ground wire.

The coaxial cable is generally applied as a high-frequency transmission line to carry a high frequency or broadband signal. Sometimes, DC power (called a bias) is added to the signal to supply the equipment at the other end, as in direct broadcast satellite receivers, with operating power. The electromagnetic field carrying the signal exists (ideally) only in the space between the inner conductor and conducting layer, so the coaxial cable cannot interfere with and/or suffer interference from external electromagnetic fields.

However, the conventional coaxial cable is low in yield and high in cost. Therefore, a coaxial cable that has great shield effectiveness and is suitable for low-cost mass production is desired.

SUMMARY OF THE INVENTION

Accordingly, a coaxial cable that has great shield effectiveness and is suitable for low-cost mass production is provided in the present cable. The coaxial cable includes at least one conducting wire; at least one insulting layer, each insulating layer being respectively coated on a corresponding conducting wire; at least one shielding layer surrounding the insulting layer; and a sheath. The shielding layer includes a polymer material and a number of carbon nanotubes embedded in the polymer material.

In one preferred embodiment, a coaxial cable is provided that includes a conducting wire, an insulating layer applied on the conducting wire, a shielding layer deposited on the insulating layer, and a sheath coating the shielding layer.

In another preferred embodiment, a coaxial cable is provided that includes a number of conducting wires, a number of insulating layers respectively applied on the corresponding conducting wires, a shielding layer surrounding all the conducting wires coated with a corresponding insulating layer, and a sheath coating the shielding layer.

In another preferred embodiment, a coaxial cable is provided that includes a number of conducting wires, a number of insulating layers respectively supplied on the corresponding conducting wires, a number of shielding layers respectively coating the corresponding insulating layers, and a sheath, in turn, surrounding all the conducting wires, each coated with a corresponding combination of an insulating layer and a shielding layer.

BRIEF DESCRIPTION OF THE DRAWINGS

Many aspects of the present coaxial cable can be better understood with reference to the following drawings. The components in the drawings are not necessarily to scale, the emphasis instead being placed upon clearly illustrating the present coaxial cable.

DETAILED DESCRIPTION OF PREFERRED EMBODIMENTS

The present coaxial cable is further described below with reference to the drawings.

The present coaxial cable includes at least one conducting wire, at least one insulating layer, each insulating layer respectively surrounding a corresponding conducting wire, at least one shielding layer encompassing the at least one insulating layer, and a sheath wrapping the above-mentioned three parts thereof. The coaxial cable is, usefully, an electromagnetic interference (EMI) shield cable.

Figure 1:
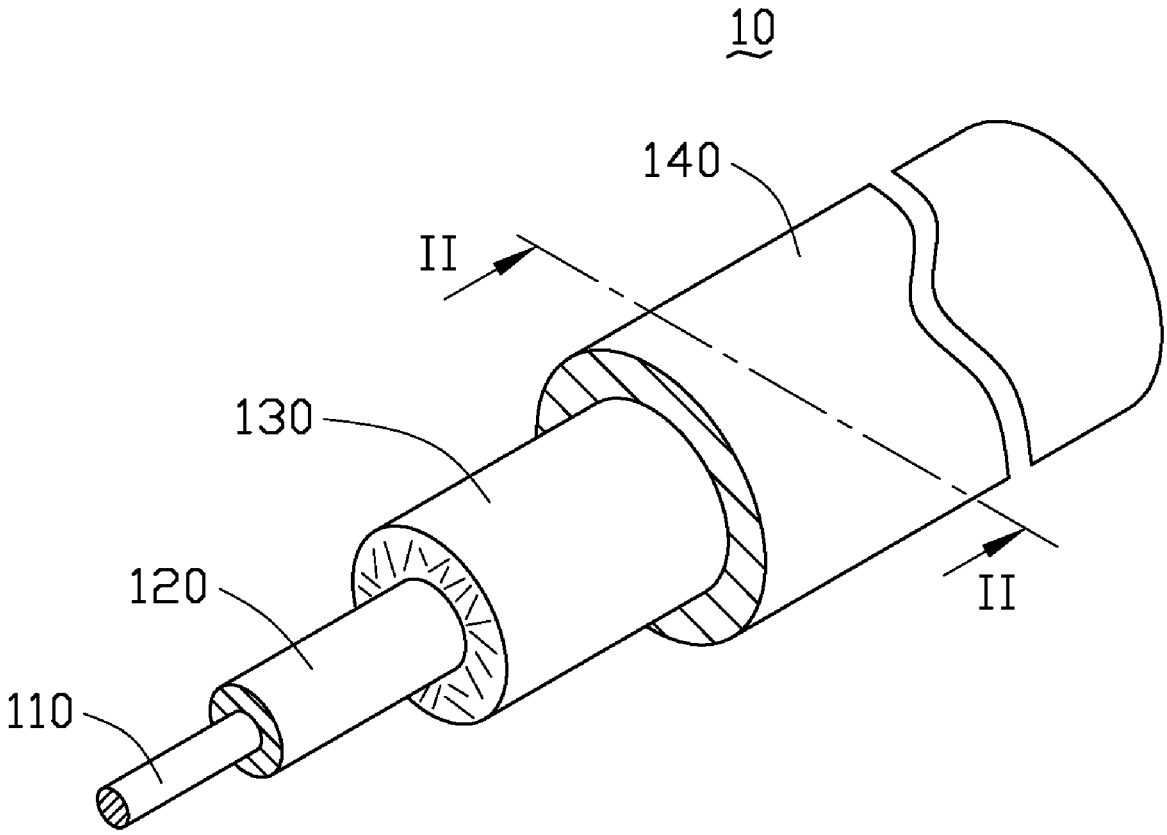
FIG. 1 is a perspective view of a coaxial cable of the first embodiment.

Referring to FIG. 1, a coaxial cable 10, according to the first embodiment, is shown. The coaxial cable 10 includes a conducting wire 110, an insulating layer 120, a shielding layer 130 and a sheath 140. The axis of the conducting wire 110, the insulating layer 120, the shielding layer 130, and the sheath 140 is consistent (i.e., such elements are coaxial), and the arrangement thereof is, in turn, from center to outer.

The conducting wire 110 can be a single wire or a number of stranded wires. The conducting wire 110 is made of a conducting material, such as a metal, an alloy, a carbon nanotube bundle, or a carbon nanotube composite having electrical conduction. Advantageous metals for this purpose are aluminum (Al) or copper (Cu). A particularly useful alloy is a copper-zinc alloy or a copper-silver alloy, wherein a mass percent of copper in the copper-zinc alloy is about 70% and that in the copper-silver alloy is about 10-40%. The carbon nanotube composite advantageously includes the carbon nanotubes and one of the above-mentioned alloys. Preferably, the mass percent of the carbon nanotubes in the carbon nanotube composite is 0.2%-10%. The carbon nanotube bundle is, usefully, a sort of carbon nanotube chain connected by van der Waals attractive forces between ends of adjacent carbon nanotubes.

The insulating layer 120 coating/surrounding the conducting wire 110 is an electric insulator/dielectric, and can be, for example, polytetrafluoroethylene (PTFE) or a nano-sized clay/polymer composite. The clay of the composite is a hydrated alumino-silicate mineral in a nano-sized layer form. The mineral can, for example, be nano-sized kaolinite or nano-sized montmorillonite. The polymer of the clay/polymer composite is, usefully, chosen from the group consisting a material of silicone, polyamide, and polyolefin, such as polyethylene and polypropylene. In the preferred embodiment, the clay/polymer composite includes nano-sized montmorillonite and polyethylene. The clay/polymer composite has many good properties such as electrically insulating, fire resistant, low smoke potential, and halogen free. The clay/polymer is an environmentally friendly material and can be applied as an electrically insulating material to protect the conducting wire and keep/maintain a certain space between the conducting wire and the shielding layer.

Figure 2:
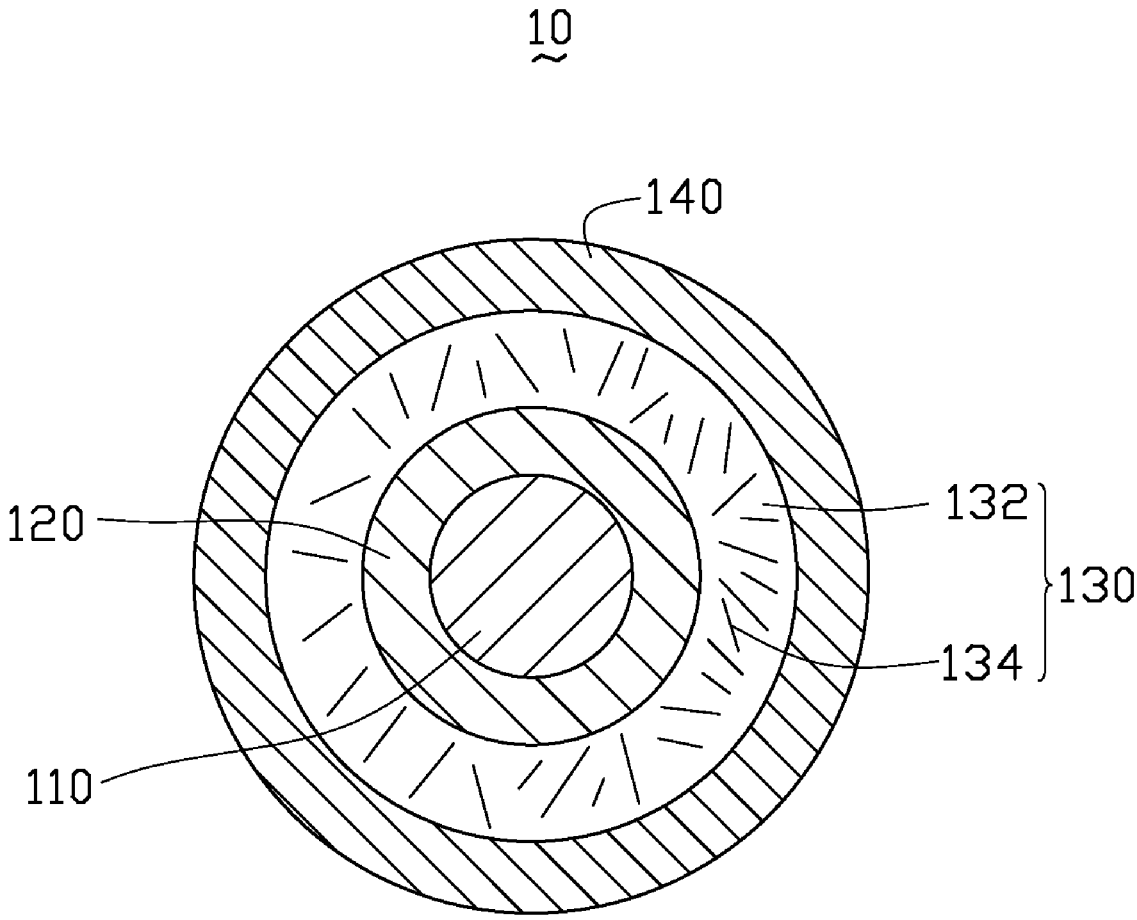
FIG. 2 is a plane, cross sectional view along the II-II direction of the coaxial cable in FIG. 1.

Referring to FIG. 2, the shielding layer 130 coating/encompassing the insulting layer 120 is a carbon nanotube/polymer composite including a polymer material 134 and carbon nanotubes 132 embedded therein. The polymer material 134 is, beneficially, a material such as polyethylene terephthalate (PET), polycarbonate (PC), acrylonitrile-butadiene styrene terpolymer (ABS), or PC/ABS. The carbon nanotubes 132 can, e.g., be single-walled carbon nanotubes, multi-walled carbon nanotubes, a single-walled carbon nanotube bundle, a multi-walled carbon nanotubes bundle, or mixtures thereof. To be uniformly distributed in the carbon nanotube/polymer composite, a preferred length of the carbon nanotubes 132 is 0.1 microns (μm) to 10 milimiters (mm), a preferred diameter of the carbon nanotubes 132 is 0.5-40 nanometers (nm), and a mass percent of the carbon nanotubes 132 in the carbon nanotube/polymer composite is 0.2-10%.

A method for manufacturing carbon nanotube/polymer composite includes the steps, as follows: providing a prepolymer solution; uniformly dispersing the carbon nanotubes 132 into the prepolymer solution; coating the prepolymer solution with the carbon nanotubes 132 therein directly on the outside of insulting layer 120; and solidifying/curing the prepolymer solution to obtain the polymer material 134 and thereby yield the carbon nanotube/polymer composite. Alternatively, another method for manufacturing carbon nanotube/polymer composite includes the following steps: melting the polymer material 134; dispersing the carbon nanotubes 132 uniformly into the melted polymer material 134; coating the melted polymer material 134 with the carbon nanotubes 132 dispersed therein directly on the outside of insulting layer 120; and solidifying the melted polymer material 134 and thereby obtaining the carbon nanotube/polymer composite, in contact with the outside of insulting layer 120.

The material of the sheath 140 is, advantageously, the same as the material used for the insulating layer 120. This kind of material has many good properties, such as good mechanical behavior, electrically insulating, fire resistant, chemically durable, low smoke potential, and halogen free. Thus, the material is an environmentally friendly material and can be applied to protect the coaxial cable 10 from external injury, such as physical, chemical, and/or mechanical injury.

Figure 3:
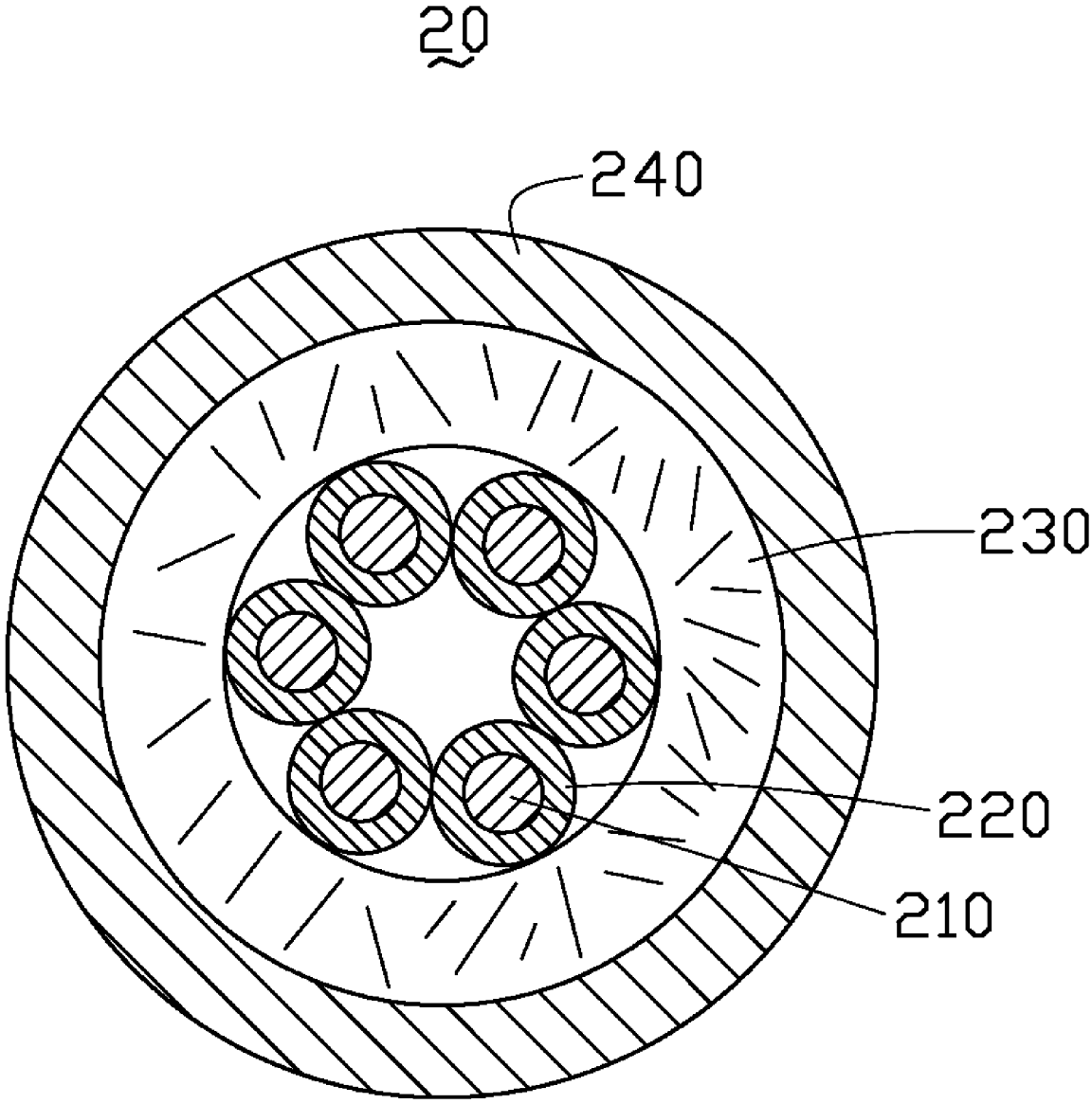
FIG. 3 is a plane, cross sectional view of a coaxial cable of the second embodiment.

Referring to FIG. 3, a coaxial cable 20, according to the second embodiment, is shown. The coaxial cable 20 includes a number of conducting wires 210, a number of insulating layers 220 each, respectively, surrounding a corresponding one of the conducting wires 210, a single shielding layer 230 surrounding all the conducting wires 210 with the corresponding insulating layer 220 coated thereon, and a single sheath 240 wrapping the shielding layer 230. The materials of the conducting wires 210, the insulting layer 220, the shielding layer 230, and the sheath 240 are substantially similar to the materials of the corresponding parts in the first embodiment.

Figure 4:
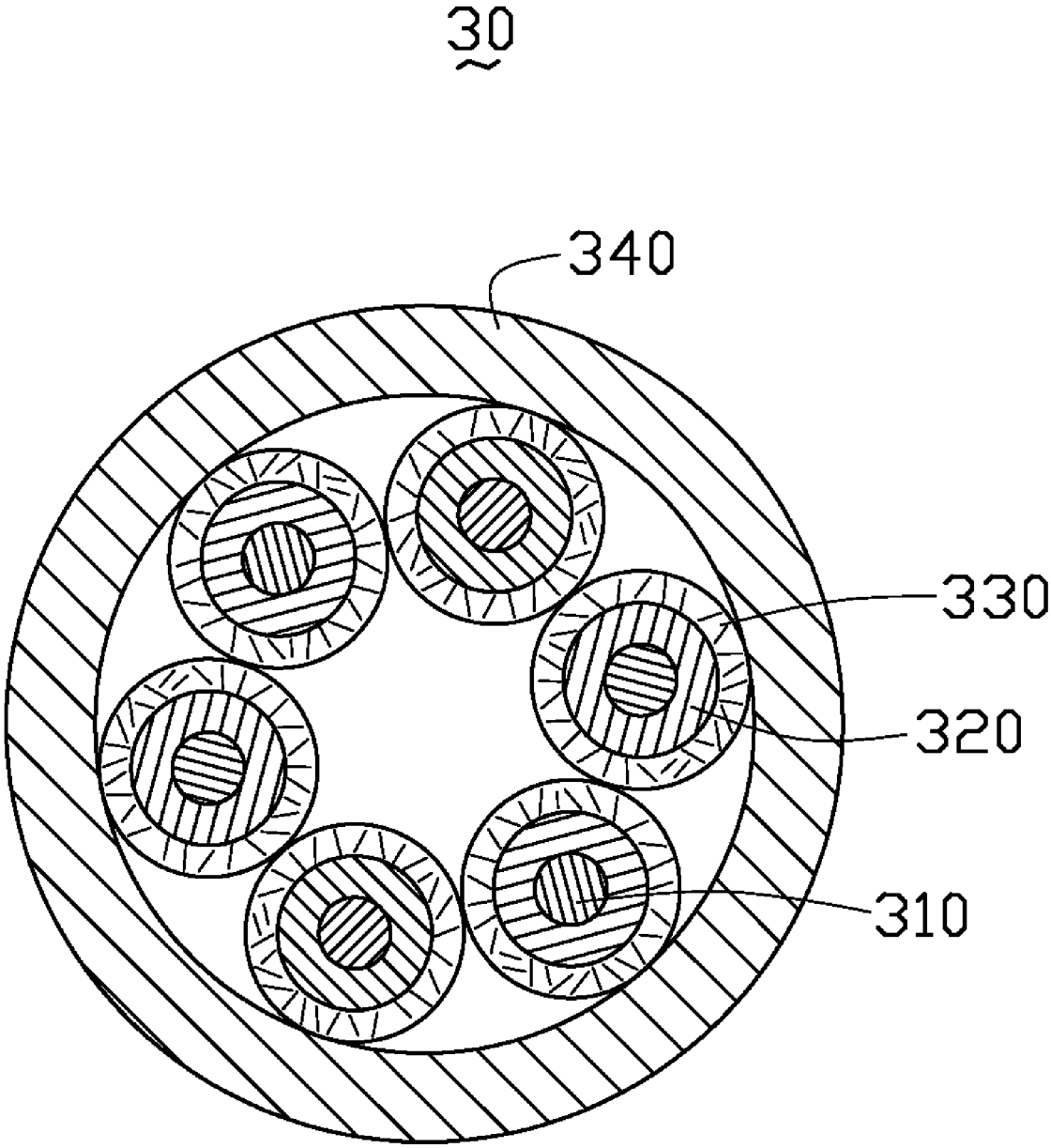
FIG. 4 is a plane, cross sectional view of a coaxial cable of the third embodiment.

Referring to FIG. 4, a coaxial cable 30, according to the third embodiment, is shown. The coaxial cable 30 includes a number of conducting wires 310, a number of insulating layers 320 respectively coating a corresponding one of the conducting wires 310, a number of shielding layers 330 respectively applied to a corresponding one the insulating layers 320, and a single sheath 340 wrapping all the conducting wires 310, as separately coated, in turn, with a corresponding insulating layer 320 and a corresponding shielding layer 330. The materials of the conducting wires 310, the insulting layers 320, the shielding layers 330, and the sheath 340 are substantially similar to the materials of the corresponding parts in the first embodiment. The arrangement of the respective shielding layers 330 each surrounding a corresponding one of the conducting wires 310 can provide quite good shielding against noises (i.e., electrical interference) from outside and between the conducting wires 310, which ensures the stable characteristics of the coaxial cable 30. Finally, it is to be understood that the embodiments mentioned above are intended to illustrate rather than limit the invention. Variations may be made to the embodiments without departing from the spirit of the invention as claimed. The above-described embodiments illustrate the scope of the invention but do not restrict the scope of the invention

What is claimed is:

1. A coaxial cable comprising:

at least one conducting wire, the conducting wire consisting of a carbon nanotube bundle, the carbon nanotube bundle being a carbon nanotube chain connected by van der Waals attractive forces between ends of adjacent carbon nanotubes:

at least one insulting layer, each insulating layer being respectively coated on a corresponding conducting wire;

at least one shielding layer surrounding the at least one insulting layer, each shielding layer comprising a polymer material and a plurality of carbon nanotubes embedded in the polymer material; and a sheath wrapping the at least one shielding layer.

2. The coaxial cable as claimed in claim 1, wherein the coaxial cable comprises a conducting wire, an insulating layer applied directly upon the conducting wire, a shielding layer coated upon the insulating layer, and a sheath wrapping the shielding layer.

3. The coaxial cable as claimed in claim 1, wherein the coaxial cable comprises a plurality of conducting wires, a plurality of insulating layers each respectively coated on a corresponding one of the conducting wires, a shielding layer surrounding all the coated conducting wires, and a sheath wrapping the shielding layer.

4. The coaxial cable as claimed in claim 1, wherein the coaxial cable comprises a plurality of conducting wires, a plurality of insulating layers respectively coated on a corresponding one of the conducting wires, a plurality of shielding layers respectively coated on a corresponding one of the insulating layers, and a sheath wrapping all the conducting wires coated, in turn, with the corresponding insulating layer and the corresponding shielding layer.

5. The coaxial cable as claimed in claim 1, wherein the polymer material is selected from a group consisting of polyethylene terephthalate (PET), polycarbonate (PC), acrylonitrile-butadiene styrene terpolymer (ABS), and PC/ABS.

6. The coaxial cable as claimed in claim 1, wherein a mass percent of the carbon nanotubes in the shielding layer is about 0.2-10%.

7. The coaxial cable as claimed in claim 1, wherein an average length of the carbon nanotubes is about 0.1 microns to 10 milimeters, and an average diameter of the carbon nanotubes is about 0.5-40 nanometers.

8. The coaxial cable as claimed in claim 1, wherein the carbon nanotubes are selected from a group consisting of single-walled carbon nanotubes, multi-walled carbon nanotubes, single-walled carbon nanotube bundle, multi-walled carbon nanotubes bundle, and mixtures thereof.

* * * * *